US006050414A

United States Patent [19]

Saffron et al.

[11] Patent Number: 6,050,414

[45] Date of Patent: Apr. 18, 2000

[54] CONTAINER WITH DISPLAY WINDOW

[76] Inventors: David M. Saffron, 2106 Mt. Olympus Dr., Los Angeles, Calif. 90046; Jack Saffron, 1030 S. Wooster Ave., #1, Los Angeles, Calif. 90035

[21] Appl. No.: 09/396,391

[22] Filed: Sep. 14, 1999

[51] Int. Cl.[7] ..... B65D 73/00

[52] U.S. Cl. ..... 206/457; 206/459.5

[58] Field of Search ..... 206/457, 459.5, 206/776, 769

[56] References Cited

U.S. PATENT DOCUMENTS 5,226,538 7/1993 Roselle ..... 206/457 X 5,673,789 10/1997 Defraff-Eugene ..... 206/457 X

*Primary Examiner*—Jacob K. Ackun

*Attorney, Agent, or Firm*—Loeb & Loeb LLP; F. Jason Far-hadian

[57] ABSTRACT

A container for holding liquid can be used, for example, as a promotional item or novelty item for a business establishment, business, product, or service. The container includes a vessel having a translucent circumferential side wall and a solid transparent window formed at a first location in the side wall. A design element is mounted at a second location on the side wall opposite the first location. When the vessel is filled with liquid to a height above the transparent window and design element, a magnified impression of the design element can be observed through the transparent window. The container can be used, for example, as a promotional item to advertise or promote a product, service, business, or business establishment, or alternatively as a novelty item for personal enjoyment and entertainment purposes.

17 Claims, 17 Drawing Sheets

CONTAINER WITH DISPLAY WINDOW

BACKGROUND OF THE INVENTION

1. Field of the Invention

The present invention relates to a container for holding liquid and, more particularly, to a container for holding liquid that can be used, for example, as a promotional item or novelty item for a business, business establishment, product, or service.

2. Description of the Related Art

In the world of advertising and promotion, objects bearing a particular trade name, design, or logo are often manufactured for heightening customer awareness of the business, establishment, product, or service to which the name, design, or logo relates. Thus, in bars, restaurants and casinos, for example, it is not uncommon to find matchbooks, coasters, glassware, plasticware, and the like, bearing some form of identification to heighten customer awareness of the establishment in which they find themselves. Unfortunately, such identifying material is most often presented in a straightforward manner such as printing on the exterior of a glass for example, that it soon becomes commonplace to the user/customer and, as a result, is unnoticed and is largely ineffective in actively promoting that which it is intended to promote.

It would thus be desirable to have a promotional article of manufacture, wherein the user/customer is not only provided with desired information, but also actively engaged with the object in a manner that entertains as it heightens awareness.

SUMMARY OF THE INVENTION

The present invention is directed to a container for holding liquid that can be used as a promotional item for a business, business establishment, product, or service. The container for holding liquid can be used as a novelty item for personal enjoyment and entertainment purposes.

In accordance with one embodiment of the present invention, a container for holding liquid comprises a vessel adapted to contain liquid therein, the vessel including a base, a translucent circumferential side wall connected to the base, and a solid transparent window formed at a first location in the side wall; and a design element arranged at a second location on the side wall opposite the first location, whereby when the vessel is filled with liquid to a height above the transparent window and the design element, a magnified impression of the design element is observable through the transparent window.

In accordance with another embodiment of the present invention, the vessel further includes a second solid transparent window formed in the side wall at the second location opposite the first location and the design element comprises a design mounted on the second transparent window.

BRIEF DESCRIPTION OF THE DRAWINGS

The present invention will now be described and will be better understood in conjunction with the accompanying drawings, in which.

DETAILED DESCRIPTION OF THE PREFERRED EMBODIMENTS

Figure 1:
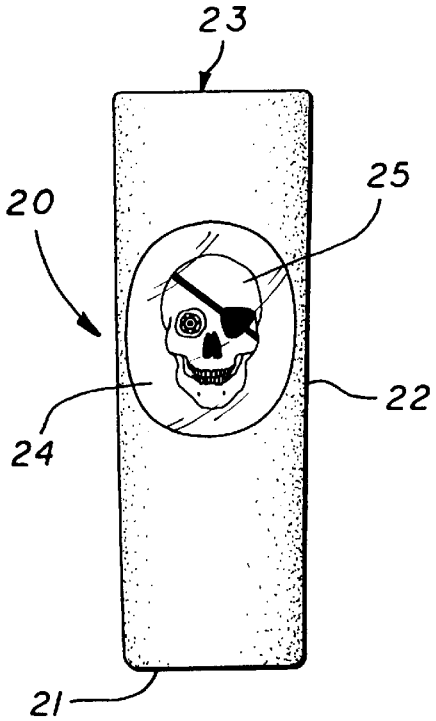
FIG. 1 is a side view of a first embodiment of a container constructed in accordance with the present invention, in which the container is empty of liquid.
Figure 2:
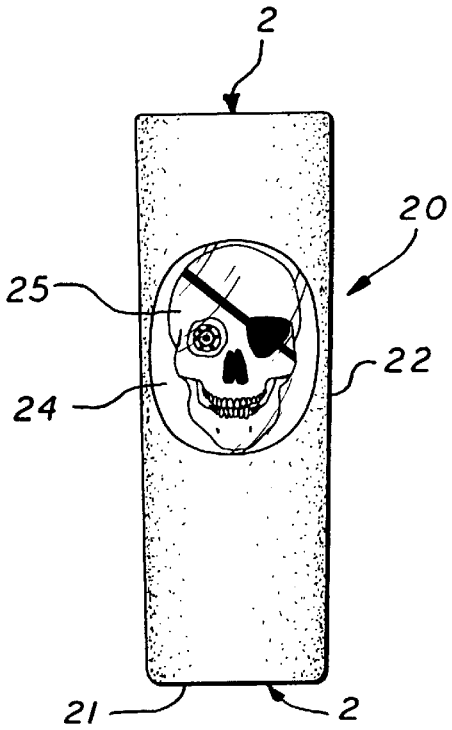
FIG. 2 is a side view of a first embodiment of a container constructed in accordance with the present invention, in which the container is filled with liquid.
Figure 3:
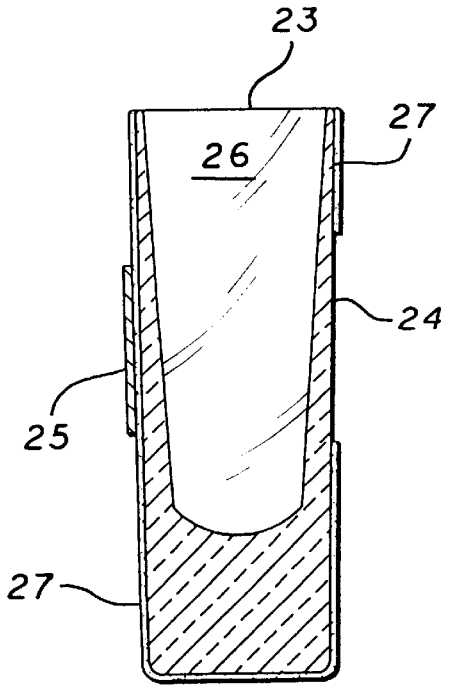
FIG. 3 is a cross-sectional view of the container shown in FIGS. 1 and 2, taken along the line 2—2 of FIG. 2.

A first embodiment of a container constructed in accordance with the present invention is illustrated in FIGS. 1 to 3.

Referring to FIG. 1, an empty container generally indicated as 20 is formed in the shape of a shot glass or liqueur glass. Container 20 includes a clear glass vessel having a base 21, a circumferential and cylindrical side wall 22 integrally formed with base 21 and an open top 23 for pouring liquid into the vessel and allowing a user to pour or drink liquid from the vessel.

As shown in FIG. 1, side wall 22 is slightly tapered outwardly such that base 21 is slightly narrower than open top 23, as is conventional with shot and liqueur glasses. The vessel of container 20 includes a translucent portion which may be a "frosted" coating or a surface texturing 27 covering a substantial portion of the surface of base 21 and side wall 22 to enhance the aesthetic appearance of the container. A portion of side wall 22 is not covered by translucent coating 27, thereby forming a clear or transparent elliptical glass window 24. By looking through transparent window 24, an observer can see into and through container 20. A design element 25, in the exemplary form of a skeleton's skull with a black eye patch, is arranged on side wall 22 at a location directly opposite transparent window 24. In this manner, a user looking through window 24 sees the design element 25 therethrough and the user's attention is directed to the design element 25. It is appreciated that the design element 25 can be text and graphic indicia without departing from the scope of the present invention.

FIGS. 2 and 3 illustrate a state in which container 20 is filled with liquid 26 to a height above transparent window 24 and design element 25. As seen best in FIG. 2, the presence of liquid 26 in container 20 causes design element 25 to be magnified through transparent window 24. In other words, a magnified image of design element 25 is observed through transparent window 24 when container 20 is filled with liquid to at least a height above transparent window 24 and design element 25. In this manner, when the container is filled with liquid, transparent window 24 functions as a magnifier for design element 25 to draw the users attention to the design element 25.

A second embodiment of a container constructed in accordance with the present invention is illustrated in FIGS. 4 to 7.

Figure 4:
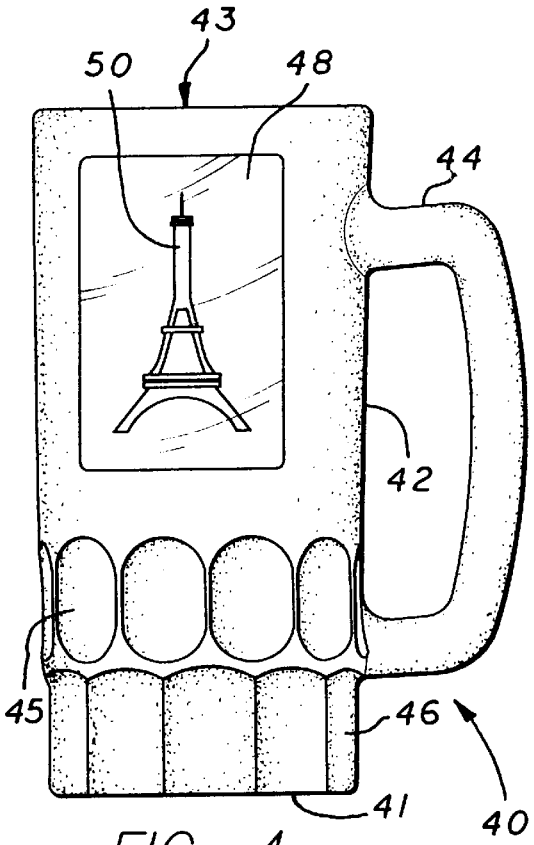
FIG. 4 is a first side view of a second embodiment of a container constructed in accordance with the present invention, in which the container is empty of liquid.
Figure 5:
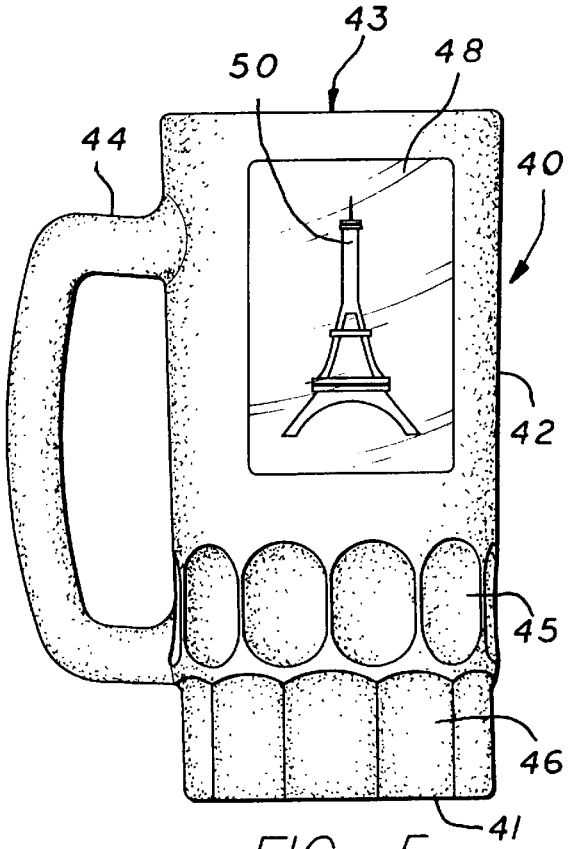
FIG. 5 is a second side view of the second embodiment, taken in a direction opposite to the direction shown in FIG. 4.

As shown in FIGS. 4 and 5, an empty drinking container generally indicated as 40 is formed in the shape of a beer mug. Container 40 includes a clear glass vessel formed of a base 41, a circumferential and cylindrical side wall 42 integrally formed with base 41, an open top 43 for pouring liquid into the container and allowing a user to drink or pour liquid from the container, a handle 44 integrally formed with side wall 42, and decorative elements or impressions 45 and 46 formed into the surface of base 41 and side wall 42.

The vessel of container 40 includes a translucent portion which may be "frosted" coating or surface texturing 47 covering a substantial portion of the surface of base 41 and side wall 42 to enhance the aesthetic appearance of the container. Two portions of side wall 42 are not covered by translucent coating 47, thereby forming a first clear or transparent rectangular glass window 48 and a second clear or transparent rectangular glass window 49 directly opposite window 48. In this manner, an observer can see into and through side wall 42 of container 40 by looking through either of windows 48 or 49. A design element 50, as shown in this example in the form of the Eiffel Tower, is arranged in transparent window 49 at a location directly opposite transparent window 48. Accordingly, a user looking through window 48 sees the design element 50 therethrough and the user's attention is directed to the design element 50.

Figure 6:
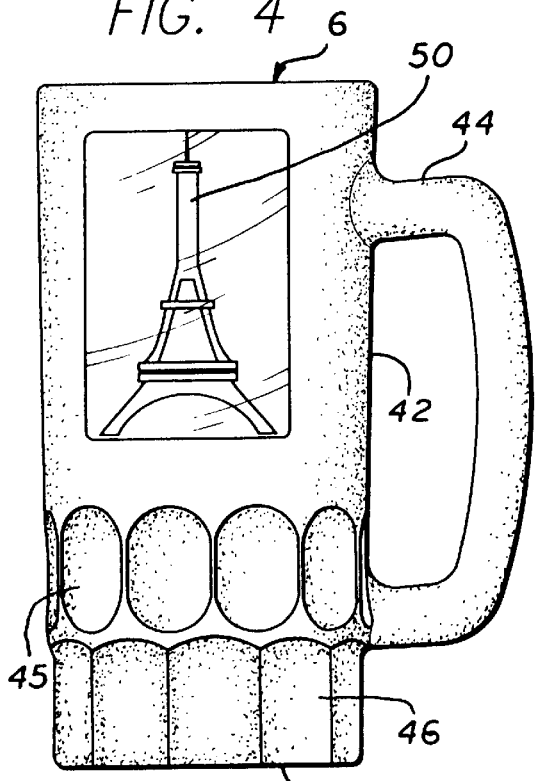
FIG. 6 is a first side view of a second embodiment of a container constructed in accordance with the present invention, in which the container is filled with liquid.
Figure 7:
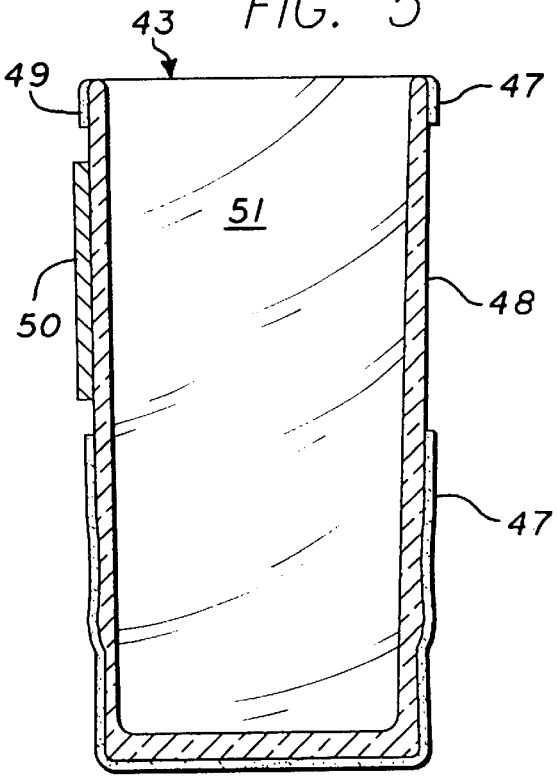
FIG. 7 is a cross-sectional view of the container shown in FIGS. 4 to 6, taken along the line 6—6 of FIG. 6.

FIGS. 6 and 7 illustrate a state in which container 40 is filled with liquid to a height at least above transparent windows 48 and 49 and design element 50. As best seen in FIG. 6, the presence of liquid 51 in container 40 causes design 50 in window 49 to be magnified through window 48. In other words, a magnified image of design 50 is observed through window 48 when container 40 is filled with liquid. In this manner, when the container is filled with liquid, transparent window 48 functions as a magnifier for design element 50 to draw the user's attention to the design element 50.

Generally, when a container of the present invention is filled with liquid, a magnification of the design element through the transparent window of approximately 10% to approximately 40% of the actual size of the design element is attained, depending on the curvature of the side wall of the container. Accordingly, the design element appears approximately 10% to approximately 40% larger than its actual size when viewed through the transparent window.

The surface area of the design element is preferably relatively smaller than the surface area of the transparent window. In this way, when the relatively smaller surface area design element is magnified through the relatively larger surface area transparent window, virtually the entire magnified design element is observable through the window. Alternatively, the surface area of the design element relative to the surface area of the transparent window, as well as the degree of curvature of the side wall of the container, can be chosen together such that a desired portion of the design element is observable through the transparent window at a selected magnification. Thus, for example, a selected portion, a major portion or substantially the entire design element can be made observable through the transparent window at a preselected magnification falling approximately within the above-noted desirable range.

While a skeleton's skull and a picture of the Eiffel Tower have been illustrated as the design elements in the described embodiments of the present invention, virtually any design including text with or without graphics, may be used as the design element without departing from the spirit and scope of the invention. In this regard, however, it is preferred for aesthetic reasons, but not required, that the design present a mirror image of itself when viewed from either side. Further, while glass has been exemplified as a preferred material for construction of the container vessel, virtually any known material for making translucent and transparent containers may be employed within the spirit and scope of the invention, including translucent and transparent plastic and the like.

Similarly, while the design element has been described in the disclosed embodiments as permanently adhered to the circumferential side wall of the container vessel, it is within the spirit and scope of the present invention to releasably adhere the design element to the circumferential side wall, thus permitting the substitution of one design element for another on a single container. This construction provides a container having a plurality of interchangeable design elements, each of which can be releasably and interchangeably secured to the container side wall as desired. Further, it will be apparent that the transparent window(s) and design element may be placed at any relative height on the side wall of the vessel, as long as the first transparent window and design element with/or without its own transparent window are placed at opposed locations, such that the design is magnified in the first window when the container is filled with liquid.

Various other modifications and alternatives will be apparent to those of ordinary skill in the art. In this regard, and merely by way of example, the container may have an open top as previously described, or may alternatively be constructed with an attached or separate cover.

Further, the present invention may be embodied in virtually any shape and size container, the liqueur glass and beer mug exemplified in the described embodiments being merely illustrative. In this regard, the present invention is ideally suited to a variety of drinking vessels that are found in commercial establishments, such as a conventional shot glass, a tall shot glass, an Arabian shot glass, a double old fashion glass, a mug with a handle such as a coffee mug, and a beer mug. Such drinking vessels typically have dimensions including a height preferably ranging from approximately 2.25 inches to approximately 6.125 inches, and a width or diameter preferably ranging from approximately 1.375 to approximately 3.375 inches, and more preferably a height ranging from approximately 2.25 inches to approximately 4 inches and a width or diameter preferably ranging from approximately 1.375 to approximately 3.125 inches.

As shown in the described embodiments, the container may have tapered side walls or straight vertical side walls. However, the shape of the side walls may vary widely. Thus, the container may have cylindrical side walls, rectangular-shaped side walls, square-shaped side walls, or any shaped side walls commonly used in glass and plastic ware, so long as a transparent window and design may be arranged on opposed surfaces of the side walls such that the design is observable through the transparent window. Similarly, the shape of the transparent window for observing the magnified design may take a variety of forms depending on the desires of the manufacturer. Thus, while the embodiments described above illustrate transparent windows of elliptical and rectangular configuration, it will be appreciated that the window may take a circular shape, a square shape, or any other desired shape that suits a designer's eye.

While the present invention has been exemplified in embodiments of drinking vessels such as a liqueur glass and a beer mug, however, it will be readily apparent that the invention finds equal utility in any container for holding and/or serving liquids, such as a beer pitcher or a wine carafe. Further, while the described embodiments are constructed with a transparent or clear vessel body covered by a translucent or frosted coating, it will be appreciated that the container can alternatively be constructed of a solid translucent vessel material having a transparent window or windows formed therein. Such alternatives are within the ordinary skill in the art and depend, for example, upon availability of materials, ease of manufacture and similar economic considerations.

Figure 67:
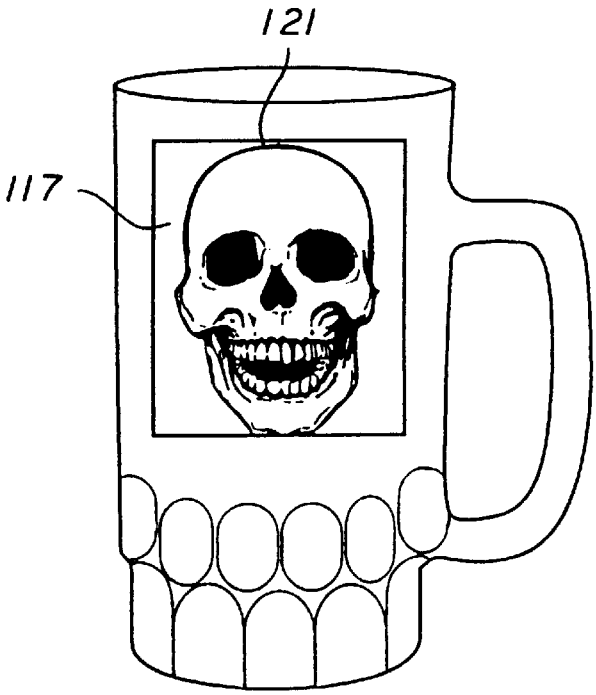

A variety of alternative and exemplary embodiments of the invention will now be described in conjunction with FIGS. 8 to 67.

Figure 8:
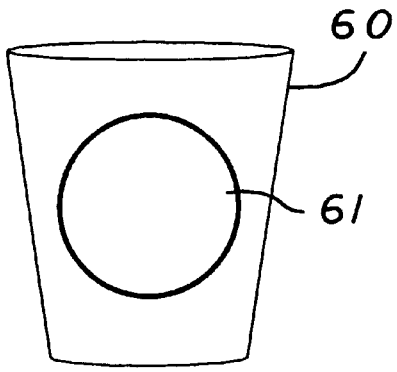
FIGS. 8 to 10 are side views of three alternative embodiments of a container constructed in accordance with the invention, in the form of a shot glass.
Figure 9:
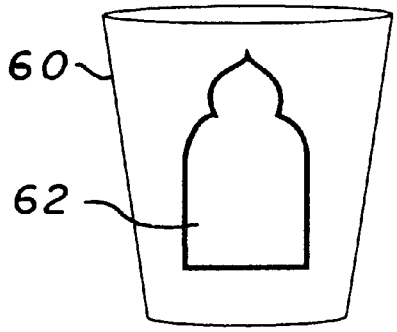
Figure 10:
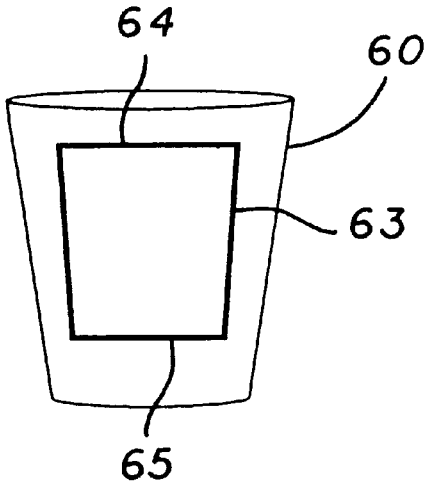

FIGS. 8 to 10 illustrate exemplary embodiments of the invention in the form of a shot glass 60 having either a circular transparent window 61, a partially-rectangular, dome-topped transparent window 62, or a trapezoidal transparent window 63. In the embodiment of FIG. 10, trapezoidal window 63 has a top edge 64 that is slightly longer than a bottom edge 65. Thus, the window tapers slightly outwardly from bottom to top, giving it a trapezoidal shape.

FIGS. 28 to 33 illustrate the shot glass embodiments of FIGS. 8 to 10 before and during use. In each of the embodiments, the design element that is arranged at a second location on the side wall opposite the window is a skeleton skull 66.

Figure 28:
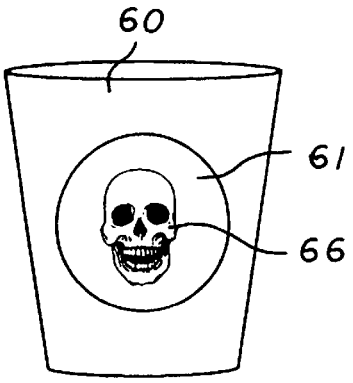
FIGS. 28 to 33 are side views of the alternative embodiments shown in FIGS. 8 to 10, with an exemplary design imprinted thereon, illustrating various embodiments of the magnifying principle of the invention.
Figure 29:
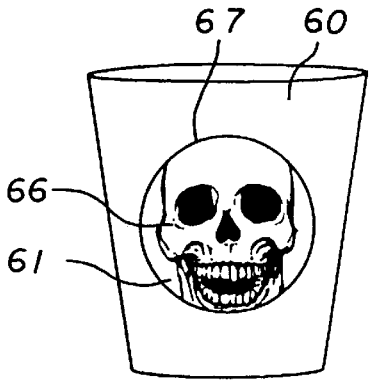

FIG. 28 shows the FIG. 8 embodiment, having circular transparent window 61 and skeleton skull 66, empty of liquid. As can be seen from FIG. 28, skeleton skull 66 is dimensioned to be relatively smaller in surface area than the surface area of circular window 61. FIG. 29 shows the FIG. 8 embodiment filled with liquid to a height above the top point 67 of window 61. Skeleton skull 66 is magnified through the liquid such that a substantial portion thereof is visible in magnified form through window 61.

Figure 30:
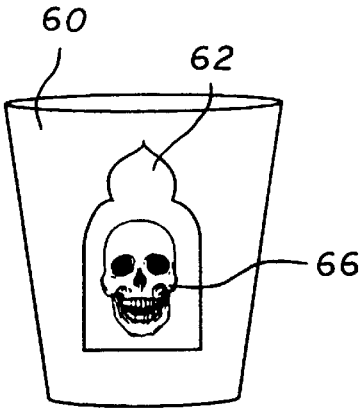
Figure 31:
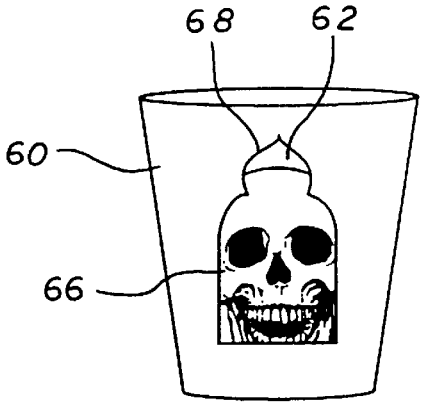

FIG. 30 shows the FIG. 9 embodiment, having a partially-rectangular, dome-topped transparent window 62 and skeleton skull 66, empty of liquid. As can be seen from FIG. 30, skeleton skull 66 is dimensioned to be relatively smaller in surface area than the surface area of window 62. FIG. 31 shows the FIG. 9 embodiment filled with liquid to a height above the top point 68 of window 62. Skeleton skull 66 is magnified through the liquid such that a significant portion of the design is visible in magnified form through window 62.

Figure 32:
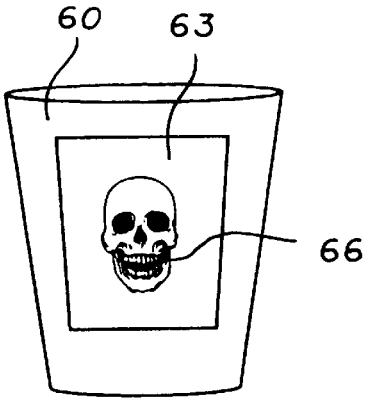
Figure 33:
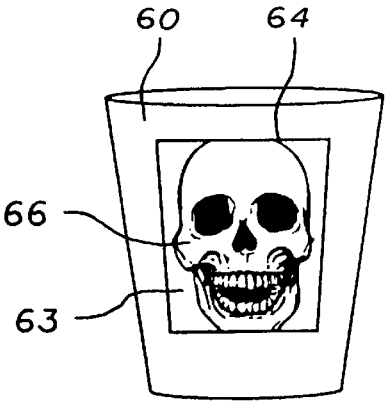

FIG. 32 shows the FIG. 10 embodiment, having trapezoidal window 63 and skull 66, empty of liquid. As can be seen from FIG. 32, skull 66 is dimensioned to be relatively smaller in surface area than the surface area of window 63. FIG. 33 shows the FIG. 10 embodiment filled with liquid to a height above top edge 64 of window 63. Skull 66 is magnified through the liquid such that nearly the entire design is visible in magnified form through window 63.

Figure 11:
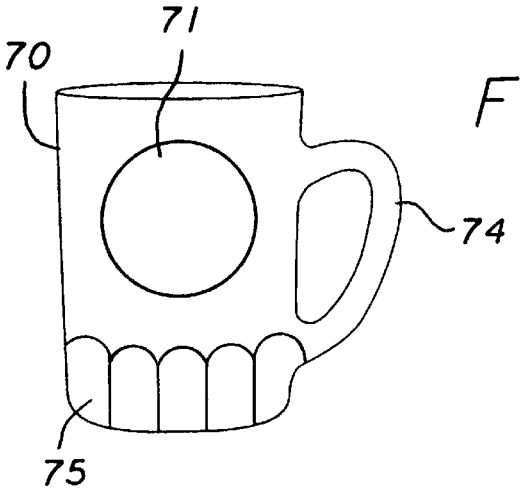
FIGS. 11 to 13 are side views of three alternative embodiments of a container constructed in accordance with the invention, in the form of an Arabian shot glass.
Figure 12:
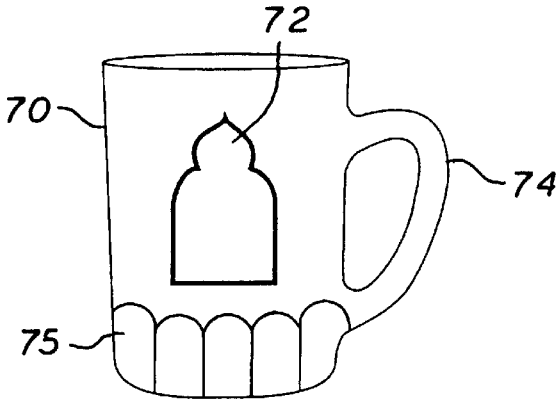
Figure 13:
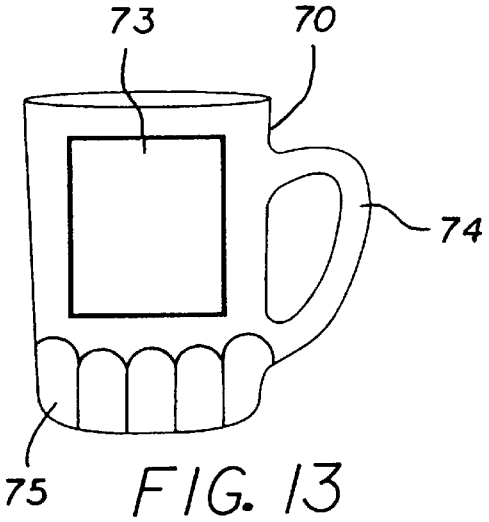

FIGS. 11 to 13 illustrate exemplary embodiments of the invention in the form of an Arabian shot glass 70 having either a circular transparent window 71, a partially-rectangular, dome-topped transparent window 72, or a rectangular transparent window 73. Arabian shot glass 70 is also provided with an integrally-formed handle 74 and decorative elements or impressions 75 formed into the side wall surface at the base of the glass.

FIGS. 34 to 39 illustrate the Arabian shot glass embodiments of FIGS. 11 to 13 before and during use. In each of the embodiments, the design element that is arranged at a second location on the side wall opposite the window is a skeleton skull 66.

Figure 34:
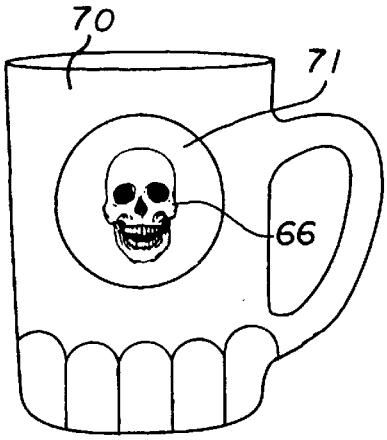
FIGS. 34 to 39 are side views of the alternative embodiments shown in FIGS. 11 to 13, with an exemplary design imprinted thereon, illustrating various embodiments of the magnifying principle of the invention.
Figure 35:
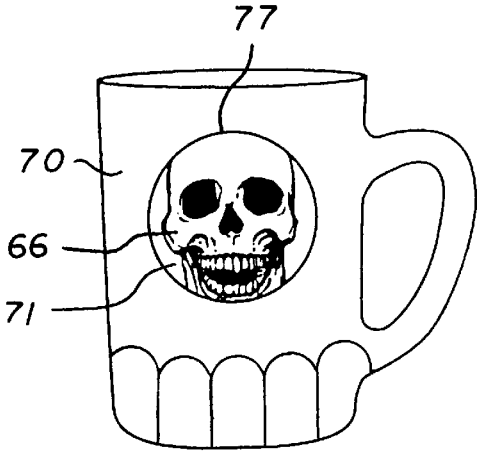

FIG. 34 shows the FIG. 11 embodiment, having circular transparent window 71 and skeleton skull 66, empty of liquid. As can be seen from FIG. 34, skeleton skull 66 is dimensioned to be relatively smaller in surface area than the surface area of circular window 71. FIG. 35 shows the FIG. 11 embodiment filled with liquid to a height above the top point 77 of window 71. Skeleton skull 66 is magnified through the liquid such that a substantial portion thereof is visible in magnified form through window 71.

Figure 36:
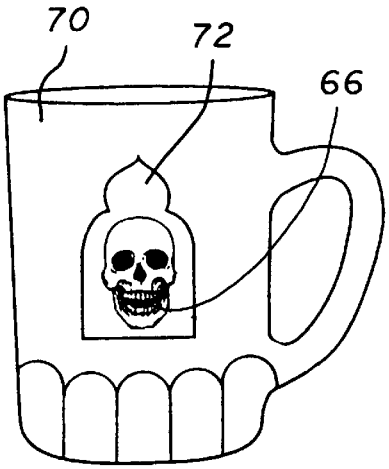
Figure 37:
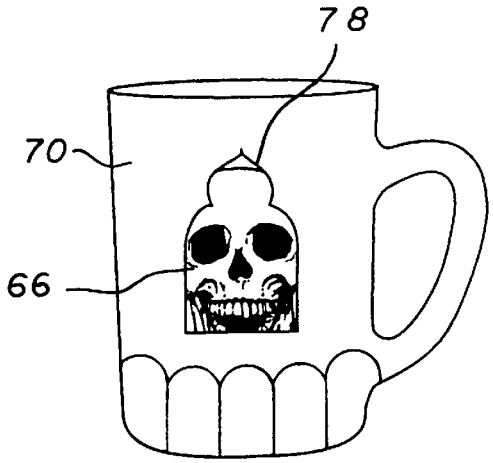

FIG. 36 shows the FIG. 12 embodiment, having a partially-rectangular, dome-topped transparent window 72 and skeleton skull 66, empty of liquid. As can be seen from FIG. 36, skeleton skull 66 is dimensioned to be relatively smaller in surface area than the surface area of window 72. FIG. 37 shows the FIG. 12 embodiment filled with liquid to a height above the top point 78 of window 72. Skeleton skull 66 is magnified through the liquid such that a substantially central portion of the design is visible in magnified form through window 72.

Figure 38:
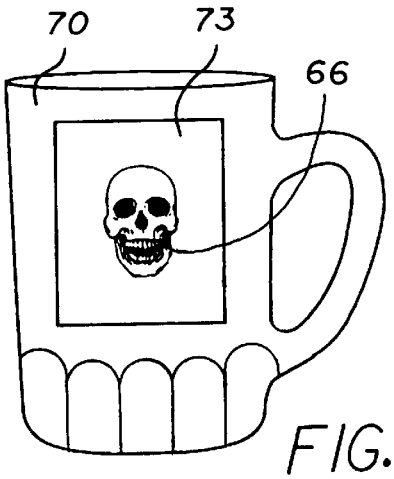
Figure 39:
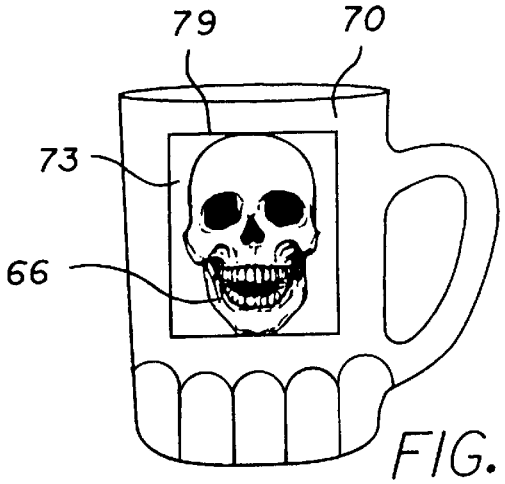

FIG. 38 shows the FIG. 13 embodiment, having rectangular window 73 and skull 66, empty of liquid. As can be seen from FIG. 38, skull 66 is dimensioned to be relatively smaller in surface area than the surface area of window 73. FIG. 39 shows the FIG. 10 embodiment filled with liquid to a height above a top edge 79 of window 73. Skull 66 is magnified through the liquid such that substantially the entire design is visible in magnified form through window 73.

Figure 15:
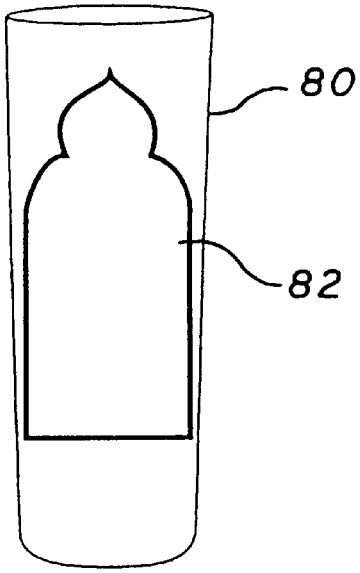
Figure 16:
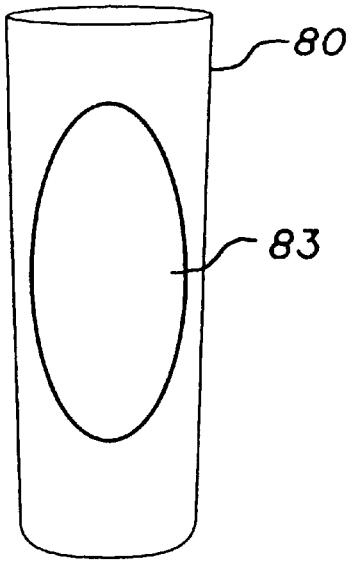
Figure 17:
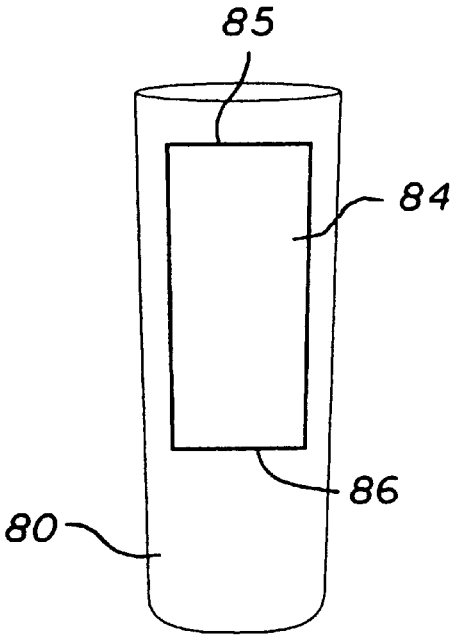

FIGS. 14 to 17 illustrate exemplary embodiments of the invention in the form of a liqueur or tall shot glass 80 having either a circular transparent window 81, a partially-rectangular, dome-topped transparent window 82, an elliptical transparent window 83, or a trapezoidal transparent window 84. In the embodiment of FIG. 17, trapezoidal window 84 has a top edge 85 that is slightly longer than a bottom edge 86. Thus, the window tapers slightly outwardly from bottom to top, giving it a trapezoidal shape.

FIGS. 40 to 47 illustrate the tall shot glass embodiments of FIGS. 14 to 17 before and during use. In each of the embodiments, the design element that is arranged at a second location on the side wall opposite the window is a skeleton skull 66.

Figure 14:
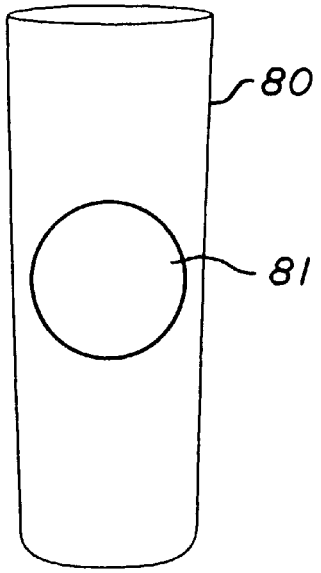
FIGS. 14 to 17 are side views of four alternative embodiments of a container constructed in accordance with the invention, in the form of a liqueur glass or tall shot glass.
Figure 40:
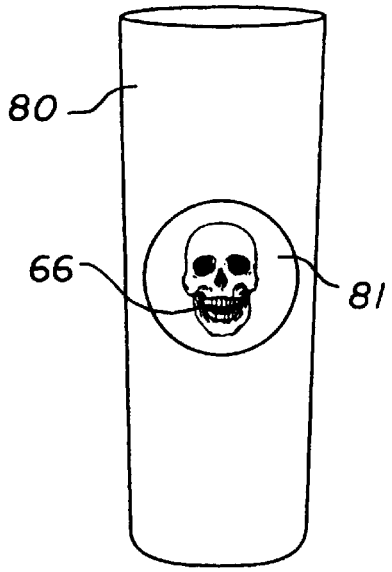
FIGS. 40 to 47 are side views of the alternative embodiments shown in FIGS. 14 to 17, with an exemplary design imprinted thereon, illustrating various embodiments of the magnifying principle of the invention.
Figure 41:
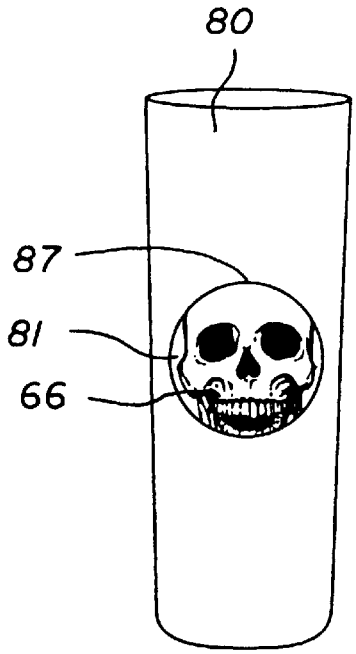

FIG. 40 shows the FIG. 14 embodiment, having circular transparent window 81 and skeleton skull 66, empty of liquid. As can be seen from FIG. 40, skeleton skull 66 is dimensioned to be relatively smaller in surface area than the surface area of circular window 81. FIG. 41 shows the FIG. 14 embodiment filled with liquid to a height above a top point 87 of window 81. Skeleton skull 66 is magnified through the liquid such that a central portion thereof is visible in magnified form through window 81.

Figure 42:
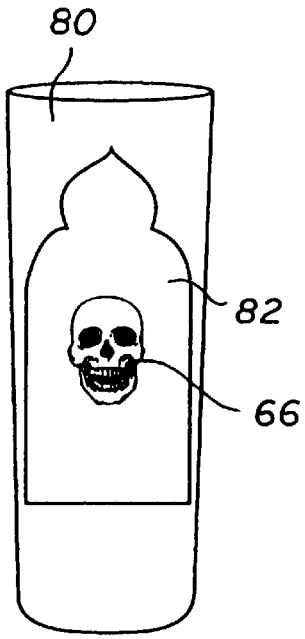
Figure 43:
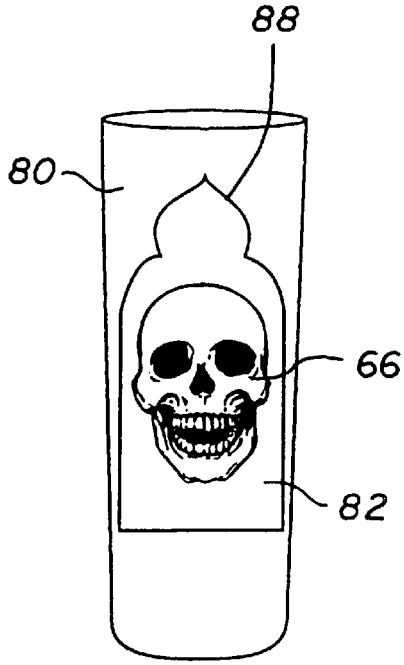

FIG. 42 shows the FIG. 15 embodiment, having a partially-rectangular, dome-topped transparent window 82 and skeleton skull 66, empty of liquid. As can be seen from FIG. 42, skeleton skull 66 is dimensioned to be relatively smaller in surface area than the surface area of window 82. FIG. 43 shows the FIG. 15 embodiment filled with liquid to a height above a top point 88 of window 82. Skeleton skull 66 is magnified through the liquid such that the entire design is visible in magnified form through window 82.

Figure 44:
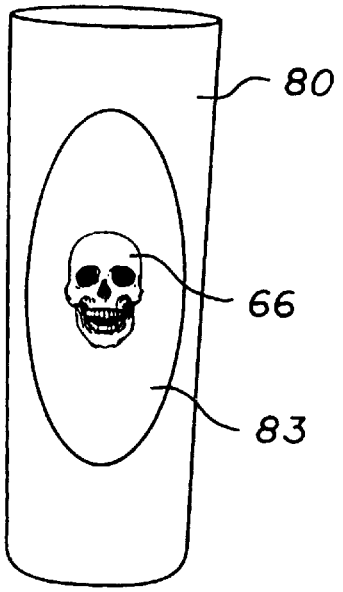
Figure 45:
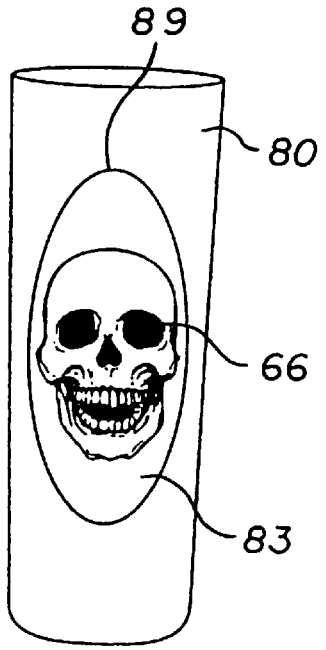

FIG. 44 shows the FIG. 16 embodiment, having elliptical transparent window 83 and skeleton skull 66, empty of liquid. As can be seen from FIG. 44, skeleton skull 66 is dimensioned to be relatively smaller in surface area than the surface area of elliptical window 83. FIG. 45 shows the FIG. 16 embodiment filled with liquid to a height above a top point 89 of window 83. Skeleton skull 66 is magnified through the liquid such that the entire design is visible in magnified form through window 81.

Figure 46:
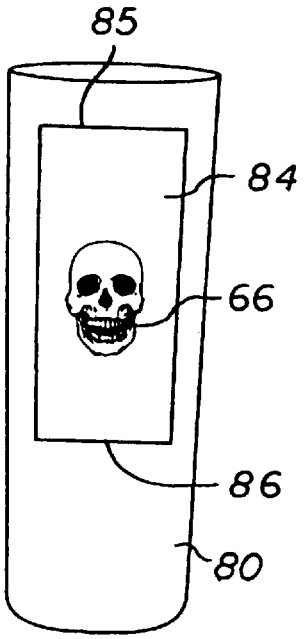
Figure 47:
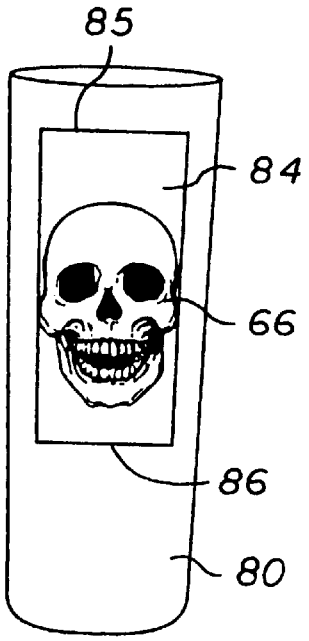

FIG. 46 shows the FIG. 17 embodiment, having trapezoidal window 84 and skull 66, empty of liquid. As can be seen from FIG. 46, skull 66 is dimensioned to be relatively smaller in surface area than the surface area of window 84. FIG. 47 shows the FIG. 17 embodiment filled with liquid to a height above top edge 85 of window 84. Skull 66 is magnified through the liquid such that virtually the entire design is visible in magnified form through window 84.

Figure 18:
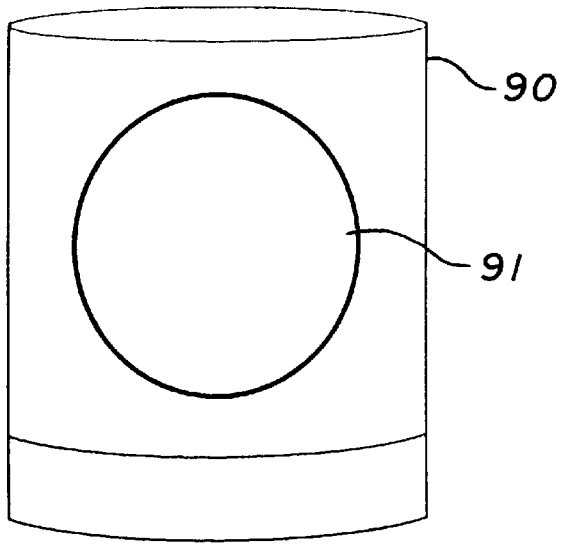
FIGS. 18 to 20 are side views of three alternative embodiments of a container constructed in accordance with the invention, in the form of a double old fashion glass.
Figure 19:
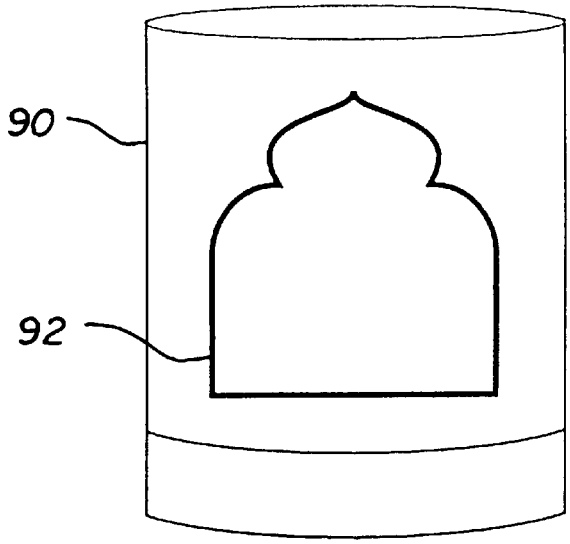
Figure 20:
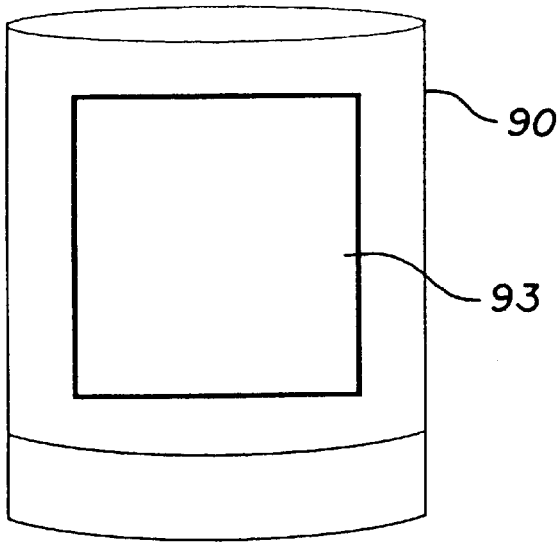

FIGS. 18 to 20 illustrate exemplary embodiments of the invention in the form of a double old fashion glass 90 having either a circular transparent window 91, a partially-rectangular, dome-topped transparent window 92, or a square transparent window 93.

FIGS. 48 to 53 illustrate the double old fashion glass embodiments of FIGS. 18 to 20 before and during use. In each of the embodiments, the design element that is arranged at a second location on the side wall opposite the window is a skeleton skull 66.

Figure 48:
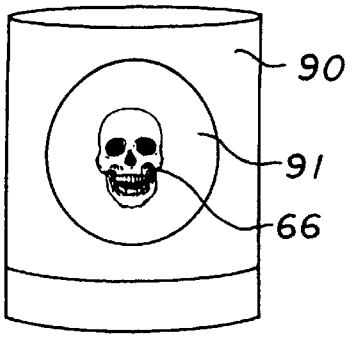
FIGS. 48 to 53 are side views of the alternative embodiments shown in FIGS. 18 to 20, with an exemplary design imprinted thereon, illustrating various embodiments of the magnifying principle of the invention.
Figure 49:
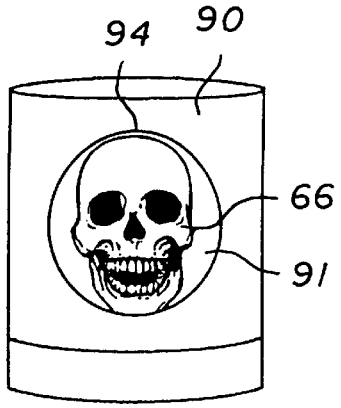

FIG. 48 shows the FIG. 18 embodiment, having circular transparent window 91 and skeleton skull 66, empty of liquid. As can be seen from FIG. 48, skeleton skull 66 is dimensioned to be relatively smaller in surface area than the surface area of circular window 91. FIG. 49 shows the FIG. 18 embodiment filled with liquid to a height above a top point 94 of window 91. Skeleton skull 66 is magnified through the liquid such that substantially the entire design is visible in magnified form through window 91.

Figure 50:
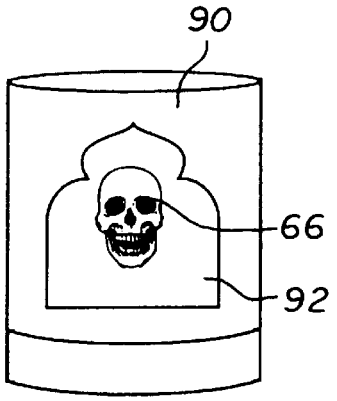
Figure 51:
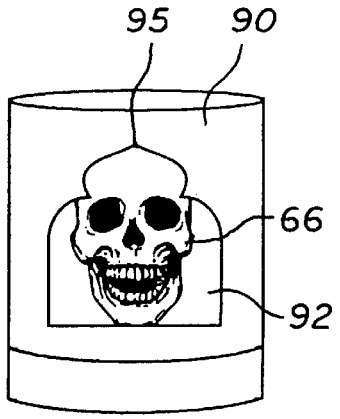

FIG. 50 shows the FIG. 19 embodiment, having a partially-rectangular, dome-topped transparent window 92 and skeleton skull 66, empty of liquid. As can be seen from FIG. 50, skeleton skull 66 is dimensioned to be relatively smaller in surface area than the surface area of window 92. FIG. 51 shows the FIG. 19 embodiment filled with liquid to a height above a top point 95 of window 92. Skeleton skull 66 is magnified through the liquid such that a major portion of the design is visible in magnified form through window 92.

Figure 52:
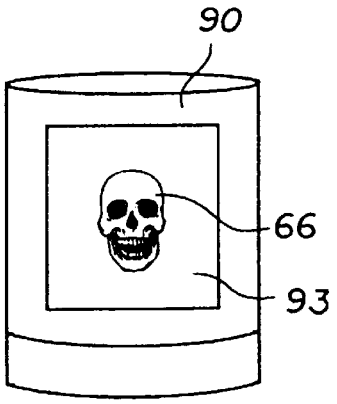
Figure 53:
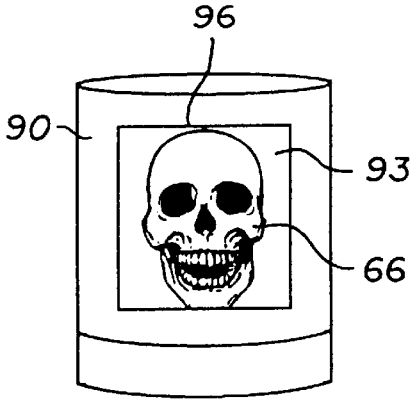
Figure 54:
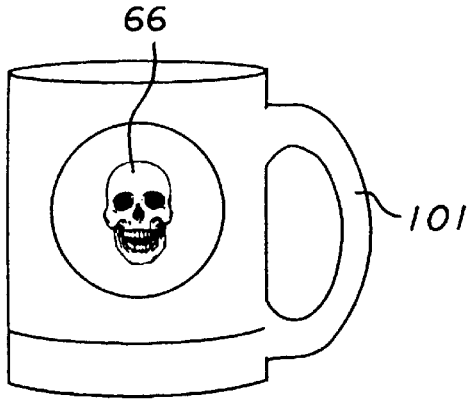
FIGS. 54 to 59 are side views of the alternative embodiments shown in FIGS. 21 to 23, with an exemplary design imprinted thereon, illustrating various embodiments of the magnifying principle of the invention.
Figure 55:
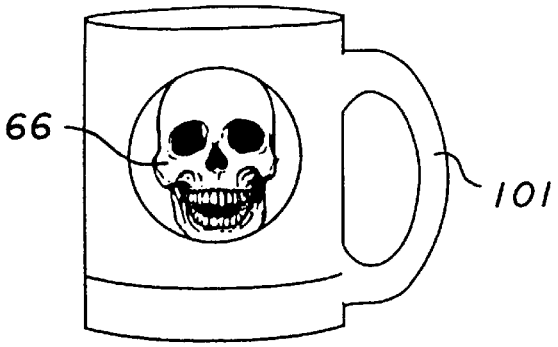
Figure 56:
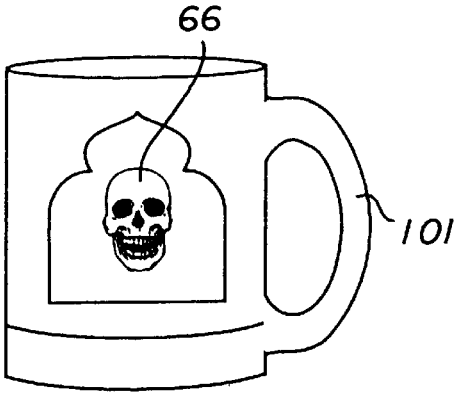
Figure 57:
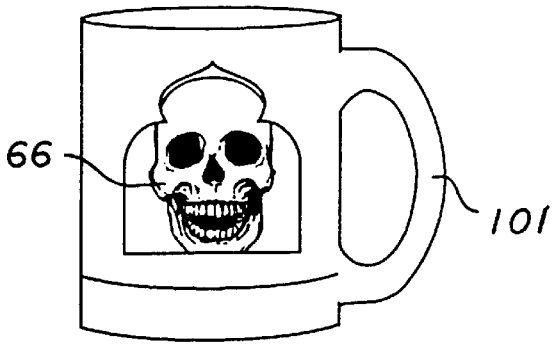
Figure 58:
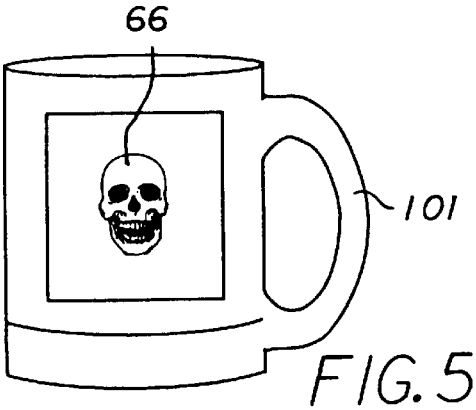
Figure 59:
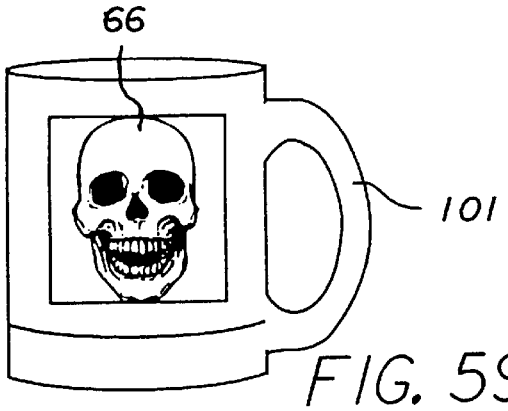

FIG. 52 shows the FIG. 20 embodiment, having square window 93 and skull 66, empty of liquid. As can be seen from FIG. 52, skull 66 is dimensioned to be relatively smaller in surface area than the surface area of window 93. FIG. 53 shows the FIG. 20 embodiment filled with liquid to a height above a top edge 96 of window 93. Skull 66 is magnified through the liquid such that substantially the entire design is visible in magnified form through window 93.

Figure 21:
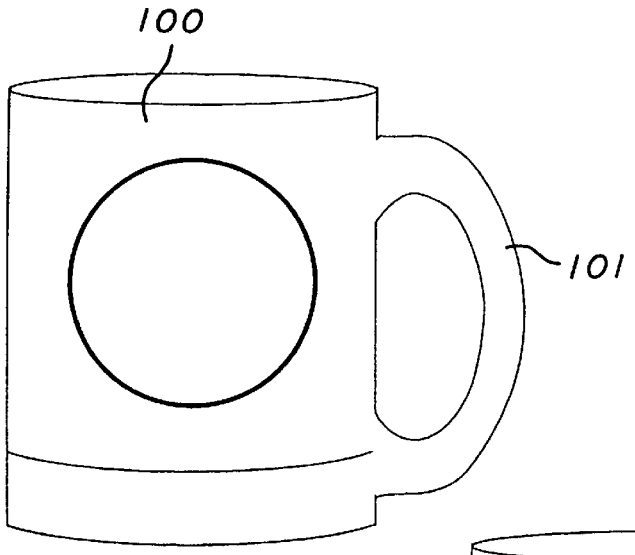
FIGS. 21 to 23 are side views of three alternative embodiments of a container constructed in accordance with the invention, in the form of a mug with a handle.
Figure 22:
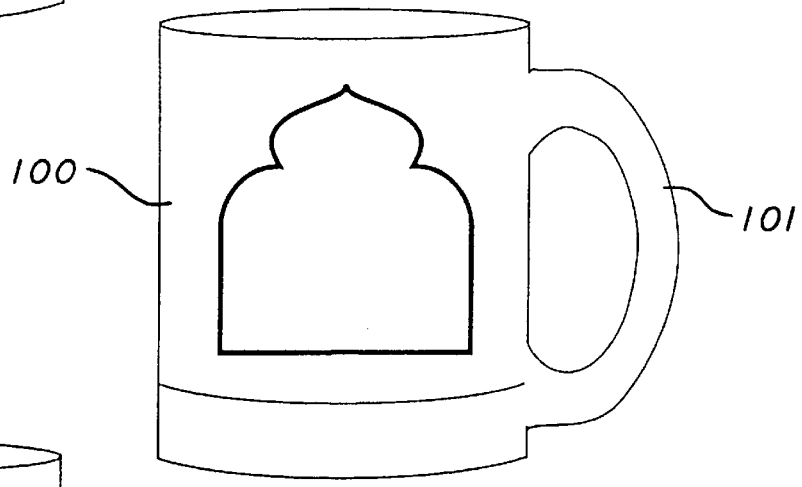
Figure 23:
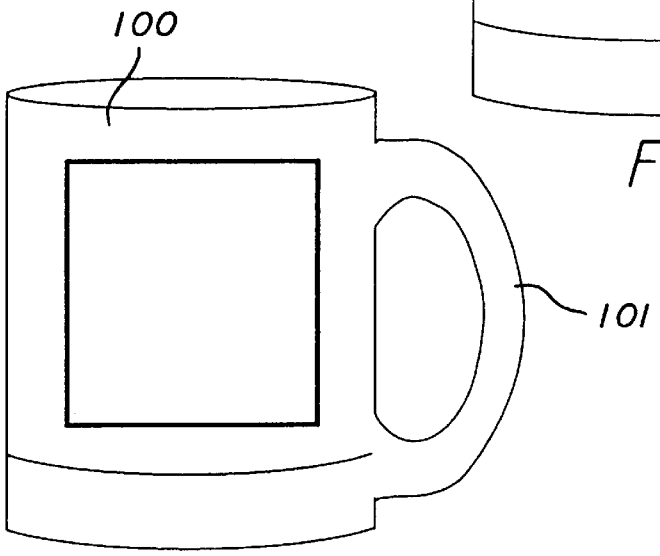

FIGS. 21 to 23 illustrate exemplary embodiments of the invention in the form of a mug 100 having a handle 101 formed integrally therein. FIGS. 54 to 59 illustrate the mug with handle embodiments of FIGS. 21 to 23 before and during use. In each of the embodiments, the design element that is arranged at a second location on the side wall opposite the window is a skeleton skull 66. The embodiments of FIGS. 21 to 23 and FIGS. 54 to 59 are substantially the same as the double old fashion glass embodiments of FIGS. 10 to 20 and FIGS. 48 to 53, with the exception of the addition of handle 101, and thus need not be described again. As can be seen from FIGS. 53 to 59, however, skull 66 is magnified through the liquid such that either a substantial portion of the design or substantially the entire design is visible in magnified form through the window.

FIGS. 24 to 27 illustrate exemplary embodiments of the invention in the form of a beer mug 110 with integral handle 111 and decorative elements or impressions 112 and 113 formed into the surface of the base and side wall of the beer mug, as described in a prior embodiment. Depending on the embodiment, beer mug 110 has a circular transparent window 114, a partially-rectangular, dome-topped transparent window 115, an oval or elliptical transparent window 116, or a rectangular transparent window 117 on a side wall of the beer mug.

FIGS. 60 to 67 illustrate the beer mug embodiments of FIGS. 24 to 27 before and during use. In each of the embodiments, the design element that is arranged at a second location on the side wall opposite the window is a skeleton skull 66.

Figure 24:
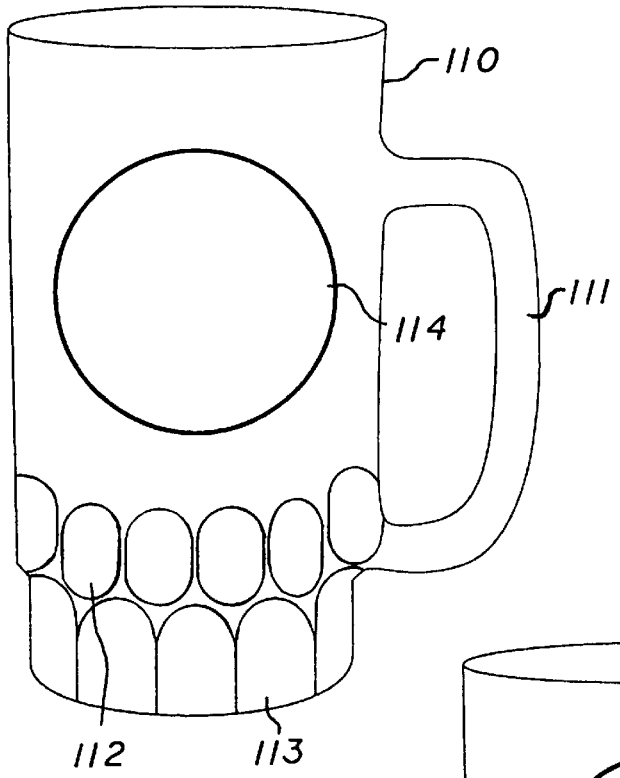
FIGS. 24 to 27 are side views of four alternative embodiments of a container constructed in accordance with the invention, in the form of a beer mug.
Figure 60:
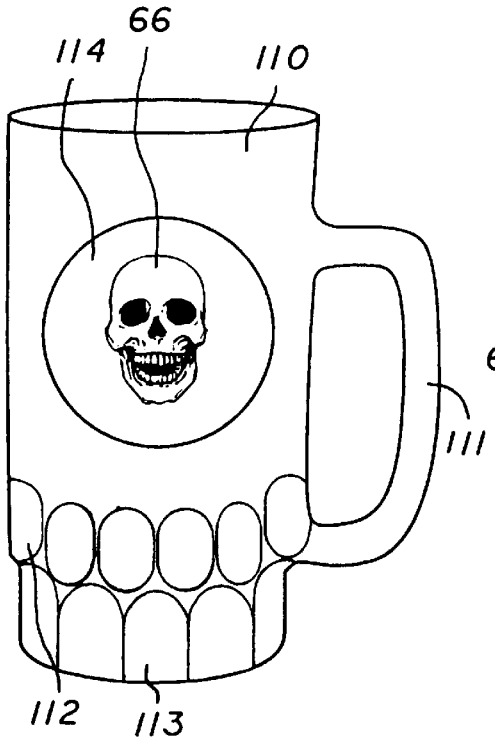
FIGS. 60 to 67 are side views of the alternative embodiments shown in FIGS. 24 to 27, with an exemplary design imprinted thereon, illustrating various embodiments of the magnifying principle of the invention.
Figure 61:
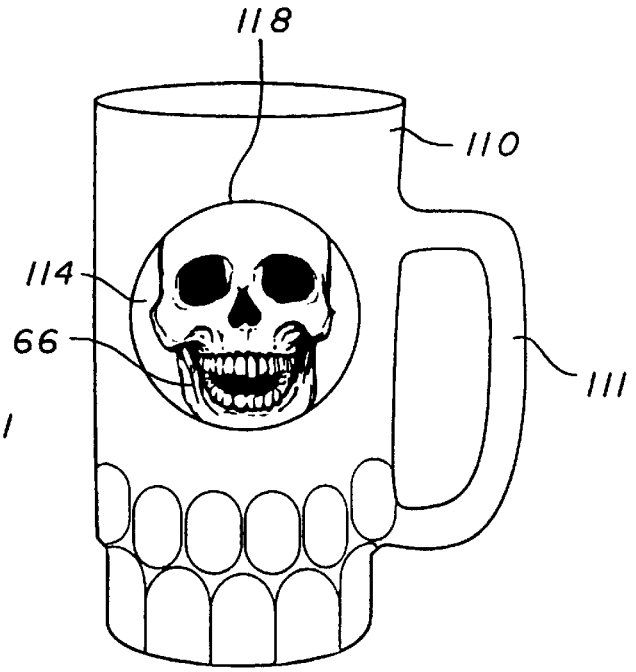

FIG. 60 shows the FIG. 24 embodiment, having circular transparent window 114 and skeleton skull 66, empty of liquid. As can be seen from FIG. 60, skeleton skull 66 is dimensioned to be relatively smaller in surface area than the surface area of circular window 114. FIG. 61 shows the FIG. 24 embodiment filled with liquid to a height above a top point 118 of window 114. Skeleton skull 66 is magnified through the liquid such that a major portion thereof is visible in magnified form through window 114.

Figure 25:
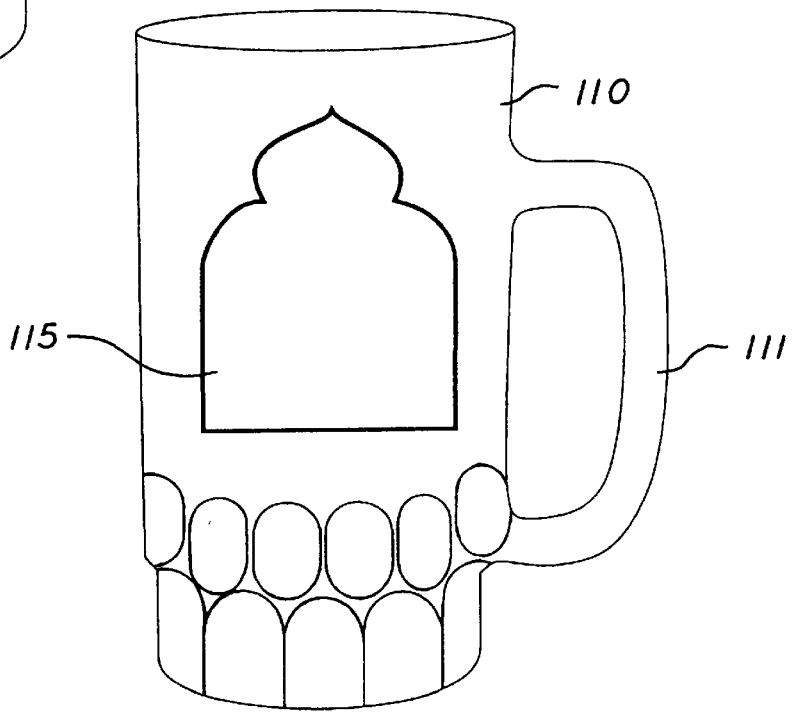
Figure 62:
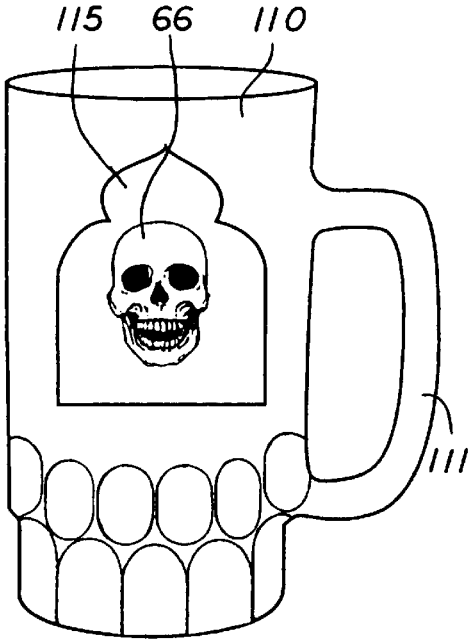
Figure 63:
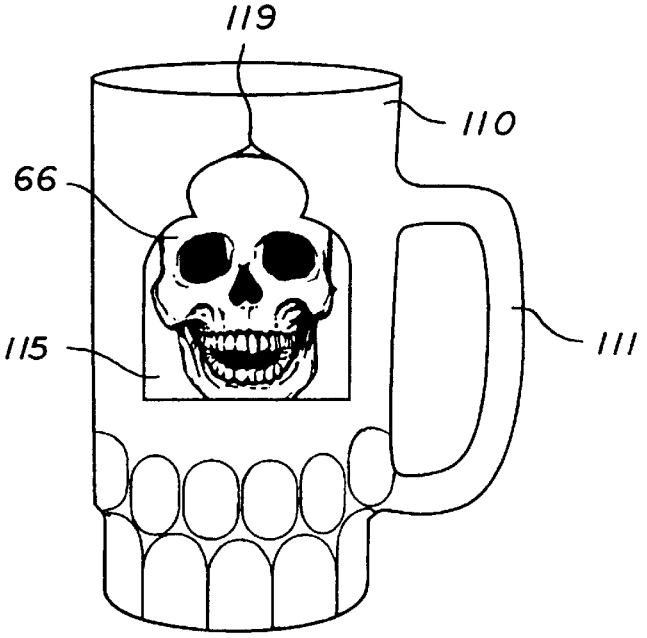

FIG. 62 shows the FIG. 25 embodiment, having a partially-rectangular, dome-topped transparent window 115 and skeleton skull 66, empty of liquid. As can be seen from FIG. 62, skeleton skull 66 is dimensioned to be relatively smaller in surface area than the surface area of window 115. FIG. 63 shows the FIG. 25 embodiment filled with liquid to a height above a top point 119 of window 115. Skeleton skull 66 is magnified through the liquid such that a substantial portion of the design is visible in magnified form through window 115.

Figure 26:
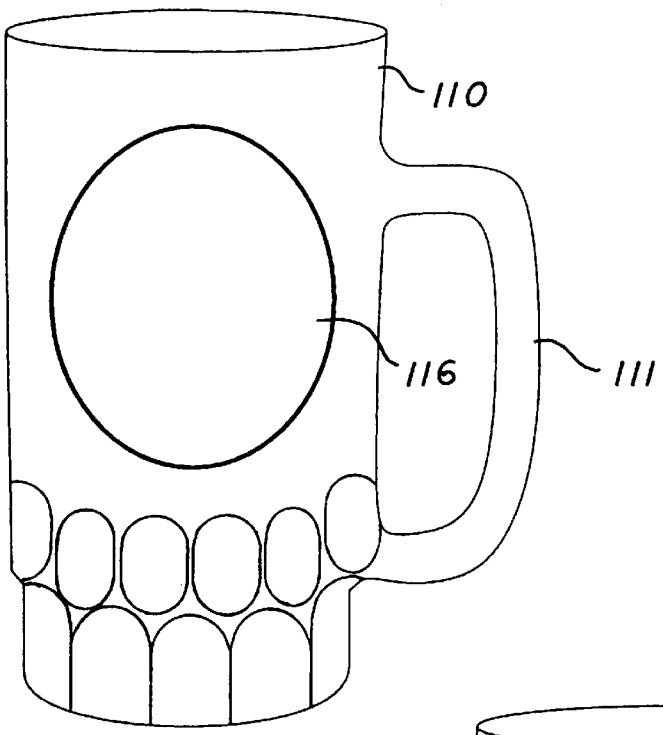
Figure 64:
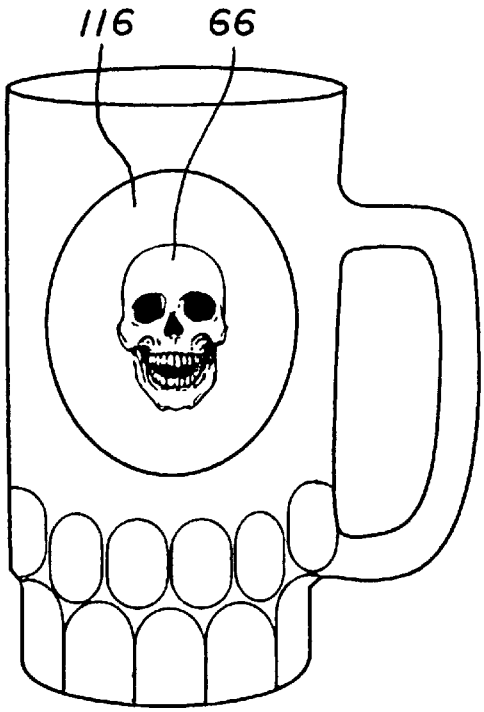
Figure 65:
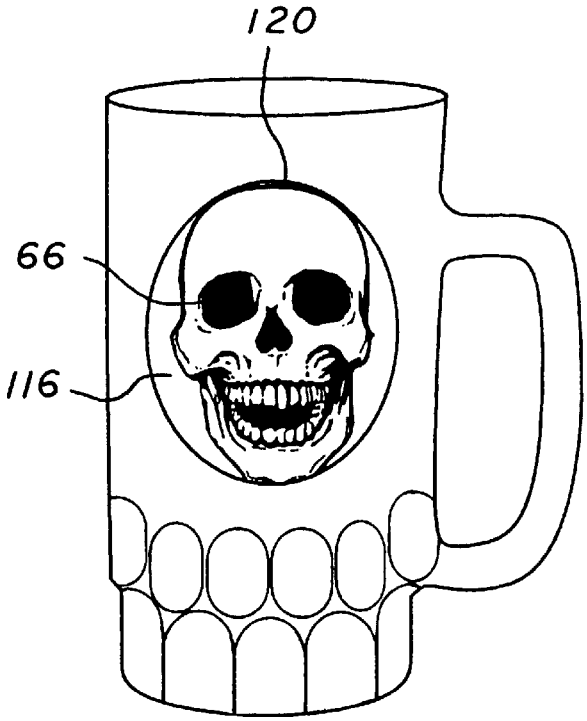

FIG. 64 shows the FIG. 26 embodiment, having elliptical transparent window 116 and skeleton skull 66, empty of liquid. As can be seen from FIG. 64, skeleton skull 66 is dimensioned to be relatively smaller in surface area than the surface area of elliptical window 116. FIG. 65 shows the FIG. 26 embodiment filled with liquid to a height above a top point 120 of window 116. Skeleton skull 66 is magnified through the liquid such that virtually the entire design is visible in magnified form through window 116.

Figure 27:
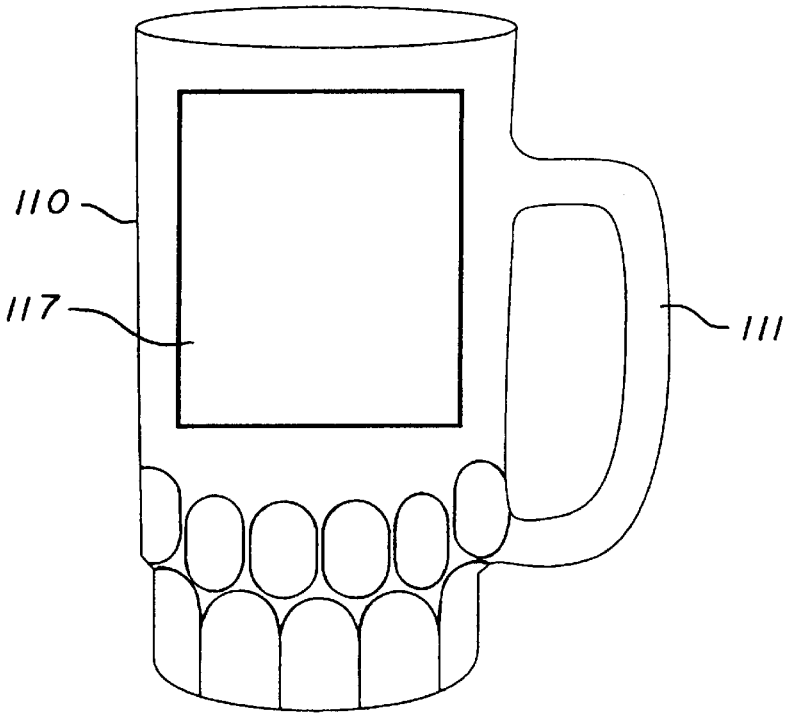
Figure 66:
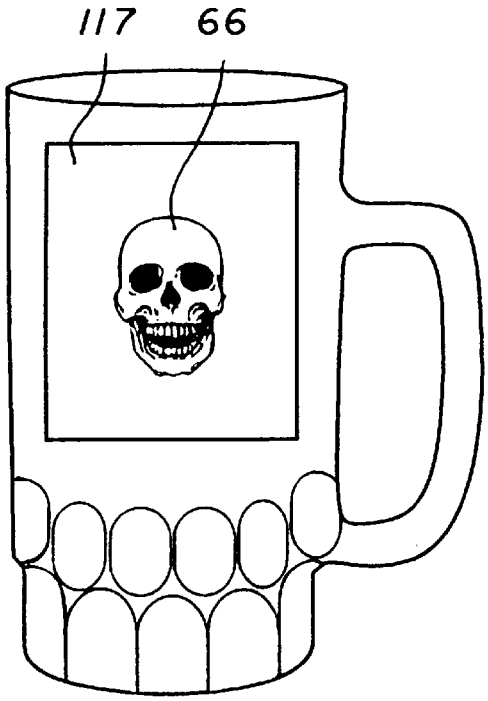

FIG. 66 shows the FIG. 27 embodiment, having rectangular window 117 and skull 66, empty of liquid. As can be seen from FIG. 66, skull 66 is dimensioned to be relatively smaller in surface area than the surface area of window 117. FIG. 67 shows the FIG. 27 embodiment filled with liquid to a height above a top edge 121 of window 117. Skull 66 is magnified through the liquid such that the entire design is visible in magnified form through window 117.

The present invention thus provides a container for holding liquid having a magnifier therein for enlarging a design element mounted on a side wall of the container when the container is filled with liquid. Such a container can find wide utility as a promotional glass, mug, pitcher, carafe, or similar container in various eating and drinking establishments, such as bars, restaurants, cafes and diners. The container of the present invention is also ideally suited to use in restaurants, gift shops and stands, souvenir shops and stands, and the like in such diverse venues as theme parks, amusement parks, carnivals, circuses, fairs, ballparks and sports arenas of all kinds where beverages are served. The container of the present invention not only heightens awareness through the magnified display of a design or logo during its use, but also provides subsequent enjoyment and amusement as a souvenir item, if it is purchased.

While the present invention has been shown and described herein in the form of particular embodiments, it will be apparent to one of ordinary skill in the art that changes and modifications may be made therein without departing from the spirit and scope of the invention as defined in the following claims.

What is claimed is:

1. A container for holding liquid comprising:

a vessel adapted to contain liquid therein, said vessel including a base, a translucent circumferential side wall connected to said base, and a first solid transparent window formed at a first location in said side wall; and a design element on said side wall at a second location opposite said first location, whereby when said vessel is filled with liquid to a height above said first transparent window and said design element, a magnified impression of said design element is observable through said first transparent window.

2. A container for holding liquid according to claim 1, wherein said first transparent window has an elliptical shape.

3. A container for holding liquid according to claim 1, wherein said first transparent window has a rectangular shape.

4. A container for holding liquid according to claim 1, wherein said first transparent window has a circular shape.

5. A container for holding liquid according to claim 1, wherein said first transparent window has a square shape.

6. A container for holding liquid according to claim 1, wherein said vessel further includes a second solid transparent window formed in said side wall at said second location, and wherein said design element comprises a design on said second transparent window.

7. A container for holding liquid according to claim 4, wherein said first transparent window and said second transparent window have the same shape.

8. A container for holding liquid according to claim 1, wherein said vessel is shaped as a shot glass.

9. A container for holding liquid according to claim 1, wherein said vessel is shaped as a liqueur glass.

10. A container for holding liquid according to claim 1, wherein said vessel is shaped as an Arabian shot glass.

11. A container for holding liquid according to claim 1, wherein said vessel is shaped as a double old fashion glass.

12. A container for holding liquid according to claim 1, wherein said vessel is shaped as a mug having a handle.

13. A container for holding liquid according to claim 1, wherein said vessel is shaped as a beer mug.

14. A container for holding liquid according to claim 1, wherein said design element is removably mounted at said second location.

15. A container for holding liquid according to claim 1, wherein said vessel is made of glass.

16. A container for holding liquid according to claim 1, wherein said vessel is made of plastic.

17. A container for holding liquid according to claim 1, wherein said vessel further includes a handle connected to said side wall.

* * * * *